US006017159A

United States Patent [19]

Tse

[11] Patent Number: 6,017,159

[45] Date of Patent: Jan. 25, 2000

[54] TAPE PRINTING APPARATUS

[75] Inventor: Yui Po Tse, Kowloon, The Hong Kong Special Administrative Region of the People's Republic of China

[73] Assignee: Esselte NV, Sint Niklaas, Belgium

[21] Appl. No.: 09/146,762

[22] Filed: Sep. 4, 1998

Related U.S. Application Data

[63] Continuation of application No. PCT/EP97/00273, Jan. 22, 1997.

[30] Foreign Application Priority Data

Mar. 7, 1996 [EP] European Pat. Off. ..... 96103521

[51] Int. Cl.[7] ..... B41J 35/28

[52] U.S. Cl. ..... 400/208; 400/120.16; 400/613; 400/692; 347/196

[58] Field of Search ..... 400/120.01, 120.16, 400/120.17, 208, 692, 691, 693, 207, 613, 249, 234; 347/196, 197

[56] References Cited

U.S. PATENT DOCUMENTS

| | | | |
|---|---|---|---|
| 4,611,936 | 9/1986 | Yasui | 400/120 |
| 4,815,871 | 3/1989 | McGourty et al. | 400/120 |
| 4,990,006 | 2/1991 | Haftmann et al. | 400/208 |
| 5,193,919 | 3/1993 | Godo et al. | 400/120.16 |
| 5,220,352 | 6/1993 | Yamamoto et al. | 346/76 |
| 5,424,757 | 6/1995 | Thom | 347/222 |
| 5,437,511 | 8/1995 | Halket et al. | 400/208 |
| 5,454,650 | 10/1995 | Yamaguchi | 400/208 |
| 5,501,539 | 3/1996 | Day | 400/613 |
| 5,540,510 | 7/1996 | Sims et al. | 400/208 |
| 5,570,962 | 11/1996 | Suzuki et al. | 400/120.16 |

FOREIGN PATENT DOCUMENTS

| | | |
|---|---|---|
| 0 267 890 A2 | 5/1988 | European Pat. Off. . |
| 0 487 313 A1 | 5/1992 | European Pat. Off. . |
| 0 607 023 A2 | 7/1994 | European Pat. Off. . |

*Primary Examiner*—Christopher A. Bennett
*Attorney, Agent, or Firm*—Pennie & Edmonds LLP

[57] ABSTRACT

The invention is directed to a tape printing apparatus having a cassette receiving bay adapted to receive a cassette which contains an image receiving tape, with a print head and a platen roll being relatively movable into an operative position ready for printing. At least one of the print head and the platen roll is operatively connected to a lid capable of closing the cassette receiving bay such that the print head and the platen roll are in their inoperative positions when the lid is open. In order to prevent the undesired effect of deformation of the platen roll when no cassette is inserted, it is proposed providing means for detecting the presence of a cassette in the cassette receiving bay, said means preventing the print head and the platen roll from being moved into their operative positions in the absence of a cassette in the cassette receiving bay.

19 Claims, 6 Drawing Sheets

TAPE PRINTING APPARATUS

CROSS-REFERENCE TO RELATED APPLICATIONS

This application is a continuation of international application PCT/EP97/00273 filed Jan. 22, 1997.

FIELD OF THE INVENTION

This invention relates to a tape printing apparatus. More particularly, this invention relates to a tape printing apparatus adapted to receive a cassette in which means are provided for detecting the presence the cassette, said means preventing the print head and platen roll from being moved into their operative position when the lid of the tape printing apparatus is closed in the absence of a cassette.

BACKGROUND OF THE INVENTION

Tape printing apparatus of the type with which the present invention is concerned are known. They operate with a supply of tape arranged to receive a printed image, and a means for transferring the image onto the tape. In one embodiment, a tape holding case or a cassette holds a supply of image receiving tape and a supply of an image transfer ribbon. The image receiving tape and the image transfer ribbon (ink ribbon) are passed in overlap through a printing zone of the tape printing apparatus. A tape printing apparatus operating with a tape holding case of this type is described, for example, in U.S. Pat. No. 4,815,871 to McGourty et al. ("the McGourty patent"). Other printing apparatus have been made in which letters are transferred to an image receiving tape by means of a dry lettering or dry film impression process. In all of these printing apparatus, the construction of the image receiving tape is substantially the same; that is, it comprises an upper layer adapted to receive a printed image and secured to a releasable backing layer by means of a layer of adhesive.

In a further tape printing apparatus as described, for example, in U.S. Pat. No. 5,424,757 to Thom, a tape holding case holds a supply of image receiving tape and a supply of an image transfer ribbon, the image receiving tape having the same construction as described in the foregoing with reference to the McGourty patent.

To perform a printing operation with the known tape printing apparatus, it is necessary to bring a thermal print head and a cooperating platen roll into an operative position in which the image receiving tape rests against the platen roll while the print head rests against the image transfer ribbon or (as a rule) against an ink ribbon. In the operative position, the print head and the platen roll exert a contact pressure against each other which is necessary to effect a printing operation. In order to be able to load a different cassette, means are provided for moving the print head and the platen roll into an inoperative position in which they are relatively spaced. This may be accomplished by moving the print head or the platen roll. This movement may, according to the Thom patent, be coupled to a lid closing the cassette receiving bay of the tape printing apparatus relative to the outside.

A disadvantage of the known tape printing apparatus is that there is contact between the platen roll and the print head in cases where no cassette is loaded and the lid is closed. As a result of the contact force of the print head against the elastic platen roll, the platen roll undergoes a substantially greater deformation than it does with a cassette loaded. A high print quality cannot be expected with a platen roll that is not of a precisely circular-cylindrical configuration. Thus, improvements in this area are needed.

SUMMARY OF THE INVENTION

The present invention provides a tape printing apparatus in which a consistently good print quality is achieved.

One aspect of the present invention is to check whether a cassette is properly loaded in the cassette receiving bay of the tape printing apparatus, and to permit a movement of the print head and the platen roll into their respective operative positions only when a cassette is loaded. In the absence of a cassette, a movement of the print head and the platen roll into the operative position is prevented from occurring, thus eliminating the possibility of contact between the platen roll and the print head.

The advantages of the present invention primarily reside in the elimination of undesired deformation of the platen roll, so that consistent print integrity is always maintained.

A further proposal involves mounting the print head or the platen roll on a support means in a manner as is known in the art, with the support means being movable between a position in which the print head and the platen roll are in the operative position, and a position in which the print head and the platen roll are in an inoperative position. The means for detecting the presence of a cassette are then configured such that they restrict the movement of the support means in such a fashion that the support means are not allowed to attain the position corresponding to the operative position unless a cassette is loaded. By contrast, when a cassette is loaded, the restriction of the movement of the support means is naturally ineffective, thus enabling the print head and the platen roll to be moved into their operative positions as usual. In this connection, it will be understood that the action of unloading a cassette invariably requires the support means to be in a position corresponding to an inoperative position of the print head and the platen roll, because otherwise the cassette cannot be removed. For this reason, it is sufficient to restrict the movement of the support means on its route from the inoperative position in the direction of the operative position.

Still further, it is sufficient to limit the movement of the support means with the cassette not loaded such that the print head and the platen roll do not make contact, thus preventing the undesired effect of deformation of the platen roll. Alternatively, yet not absolutely necessarily, it may be contemplated to lock the support means in a position which corresponds to the inoperative position.

Finally, for design reasons it is preferred to arrange the support means so as to be pivotal about a pivot point.

It is recommended to equip the means for detecting the presence of a cassette in the cassette receiving bay with a movable element whose movement is caused by an inserted cassette. The element is capable of occupying two positions. The first position is occupied with no cassette loaded; the print head and the platen roll are prevented from moving into their operative positions. The second position is occupied with a cassette properly loaded; the print head and the platen roll are movable into an operative position. As a rule, the element is slidably or rotatably mounted.

To cause the element to occupy the appropriate position with no cassette loaded, and the movement of the support means restricted, a suitable spring may be useful.

For lateral alignment of the element in a loaded cassette, an opening or recess may be provided in the cassette. For this purpose, the element is provided with a suitable head entering the opening or recess.

Because the element is in contact with a loaded cassette, it is necessary for at least part of the element to be disposed in the cassette receiving bay. However, the remaining mechanism, such as the movable support means carrying the print head or the platen roll are, as a rule, not in the cassette receiving bay, but at a location beyond a bottom plate of said cassette receiving bay. Therefore, the element preferably extends through a corresponding opening in the base plate in which it may also be carried in a guided relationship thereto.

The connection between the print head (or the platen roll) and the lid is preferably realized in the form of a spring, which is on its first end connected to the print head (or the platen roll) and on its second end coupled with the lid, at least when the latter is in its closed position. The spring pulls the print head (or platen roll) into its operative position such that the correct force for printing is applied. However, when no cassette has been inserted, the means for detecting the presence of a cassette in the cassette bay restrict the movement of the support means of the print head (or platen roll) such that they do not get into the operative position.

Further, a rotatably supported member can be provided which is connected to the second end of the spring and engages with the lid when in its closed position. The closing movement of the lid consequently causes the rotatably supported member to rotate such that the second end of the spring moves together with it, and the required force is applied to move the print head (or platen roll) into its operative position. It is sufficient for the rotatably supported member only to touch the lid when the latter is near its closed position; it is not necessary that the rotatably supported member be permanently coupled to the lid.

The present invention further comprises in combination: a tape printing apparatus having a cassette receiving bay adapted to receive a cassette which contains an image receiving tape, in which an openable lid on the cassette receiving bay is provided, and in which a print head and a platen roll are relatively movable into an operative position ready for printing, wherein at least one of the print head and platen roll is operatively connected to the lid such that the print head and the platen roll are in their inoperative position when the lid is open, and means are provided for detecting the presence of a cassette in the cassette receiving bay, said means preventing the print head and the platen roll from being moved into their operative positions when the lid is closed in the absence of a cassette; and a cassette inserted, or suitable for insertion, in the cassette receiving bay, said cassette cooperating with the means for detecting the presence of a cassette such as to allow a movement of the print head and the platen roll into their operative positions with the cassette in inserted condition.

BRIEF DESCRIPTION OF THE DRAWINGS

A preferred embodiment of the present invention will be described in greater detail in the following with reference to the accompanying drawings. In the drawings showing schematic representations.

DESCRIPTION OF THE PREFERRED EMBODIMENTS

Figure 1:
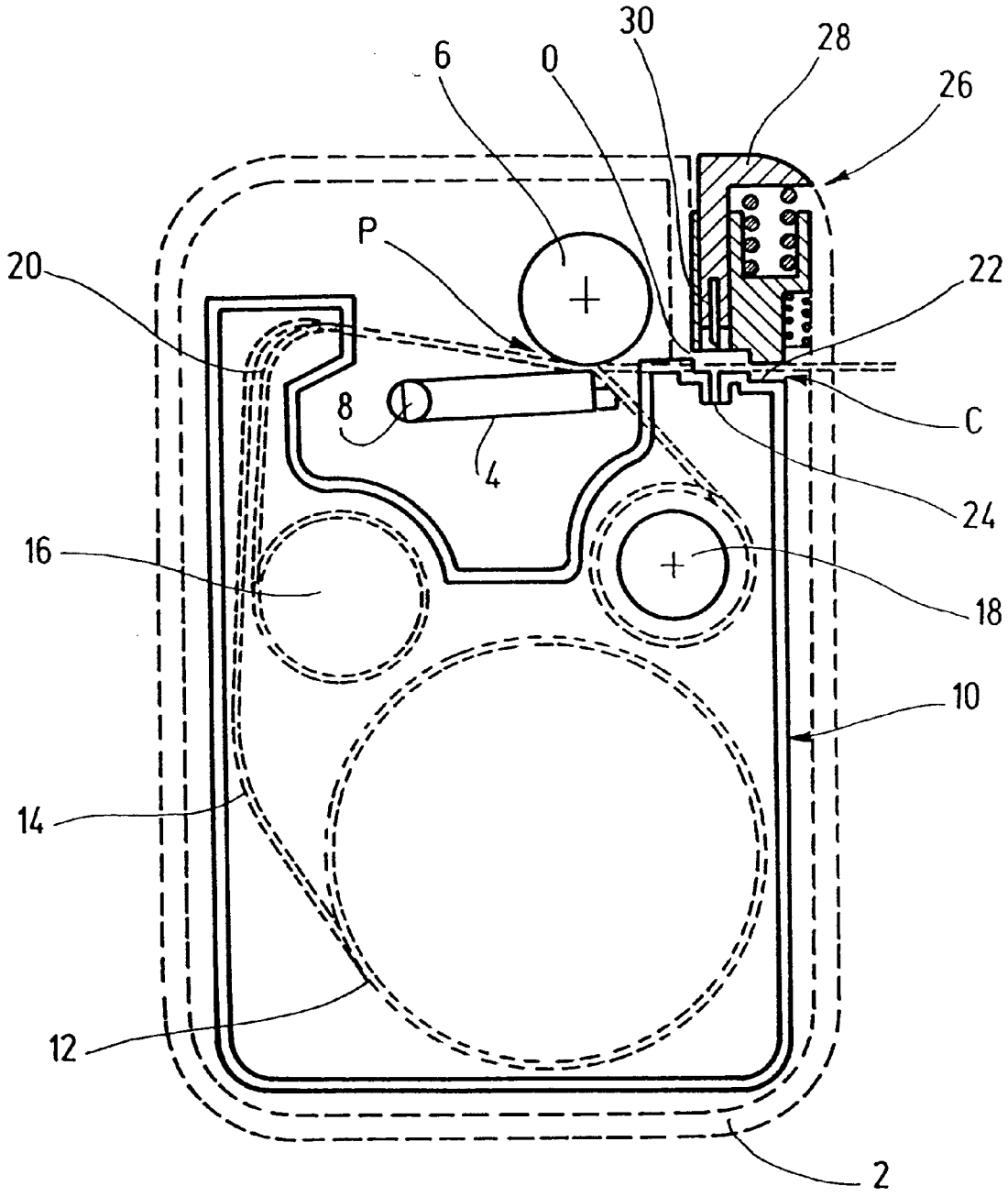
FIG. 1 is a view of a tape printing apparatus with a cassette inserted therein.

FIG. 1 is a plan view of a cassette receiving bay of a tape printing apparatus. The cassette receiving bay is shown by the broken line 2. It accommodates a (thermal) print head support means 4 and a platen roll 6 which cooperate to define a print zone P in a manner known in the art. The print head support means 4 is pivotable about a pivot point 8, thus enabling the print head to be brought into contact with, and moved away from, the platen roll 6 for removal and replacement of a cassette 10.

A cassette 10 is inserted into the cassette receiving bay 2. The cassette 10 holds a supply spool 12 of image receiving tape 14 which comprises an image receiving layer secured to a backing layer by means of a layer of adhesive. The image receiving tape 14 is guided by a guide mechanism, not shown, through the cassette 10, exiting the cassette through an outlet 0 shortly after having passed the print zone, to be subsequently routed to a cutting location C. The cassette 10 further accommodates an ink ribbon supply spool 16 and an ink ribbon take-up spool 18. The ink ribbon 20 is guided from the ink ribbon supply spool 16 through the print zone P and wound up on the ink ribbon take-up spool 18. Together with the ink ribbon 20, the image receiving tape 14 passes through the print zone P with its image receiving layer in contact with the ink ribbon 20.

In the tape printing apparatus illustrated in FIG. 1, the platen roll 6 is driven so that it rotates, guiding the image receiving tape 14 through the print zone P during printing. As this occurs, the tape 14 is printed and fed out from the print zone P to the cutting zone C. The cutting zone C is provided at a location on the wall of the cassette 10 which is close to the print zone P. As the tape 14 is pulled out of the cassette 10 by driving the platen roll 6, there is no need for a further tape feed mechanism; the cutting zone C is arranged close to the print zone. The portion of the wall of the cassette 10 where the cutting zone C is defined is denoted by reference numeral 22. A slot 24 is defined in this wall portion 22. The image receiving tape 14 is fed from the print zone P to the cutting zone C where it is supported by facing wall portions on either side of the slot 24.

The tape printing apparatus includes a cutting mechanism 26. This cutting mechanism 26 includes a cutter support member 28 carrying a blade 30. The blade 30 severs the tape 14 and then enters the slot 24. FIG. 1 shows the cutting mechanism 26 in its ready-to-cut state, that is, in a position where the blade 30 is spaced from the tape 14. This permits the free leading edge of the tape 14 to be fed through the cutting zone C without the risk of catching on it or being deflected by it.

Figure 2:
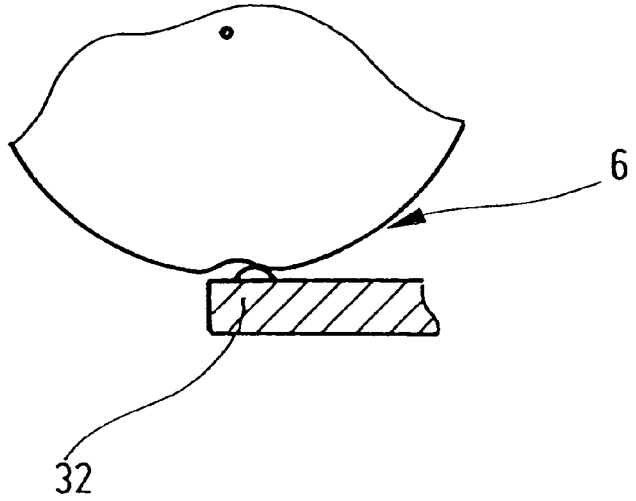
FIG. 2 is a view of a print head shown in contact with a platen roll.

The disadvantage of conventional tape printing apparatus will become apparent from FIG. 2. With no cassette 10 loaded, that is, in the absence of a tape 14 between the print head 32 and the platen roll 6, the print head 32 is urged into pressure contact with the platen roll 6 made of an elastic material such as rubber, risking permanent deformation of the platen roll. The undesired result is an unsatisfactory print quality caused by the non-circular, deformed platen roll 6. However, with a cassette 10 loaded and a tape 14 present between the print head 32 and the platen roll 6, the contact pressure is distributed over a greater area because of the relatively stiff tape 14; any contact between the platen roll 6 and sharp edges, if any, of the print head 32 is not possible, so that the undesired deformation of the platen roll need not be feared.

Figure 3:
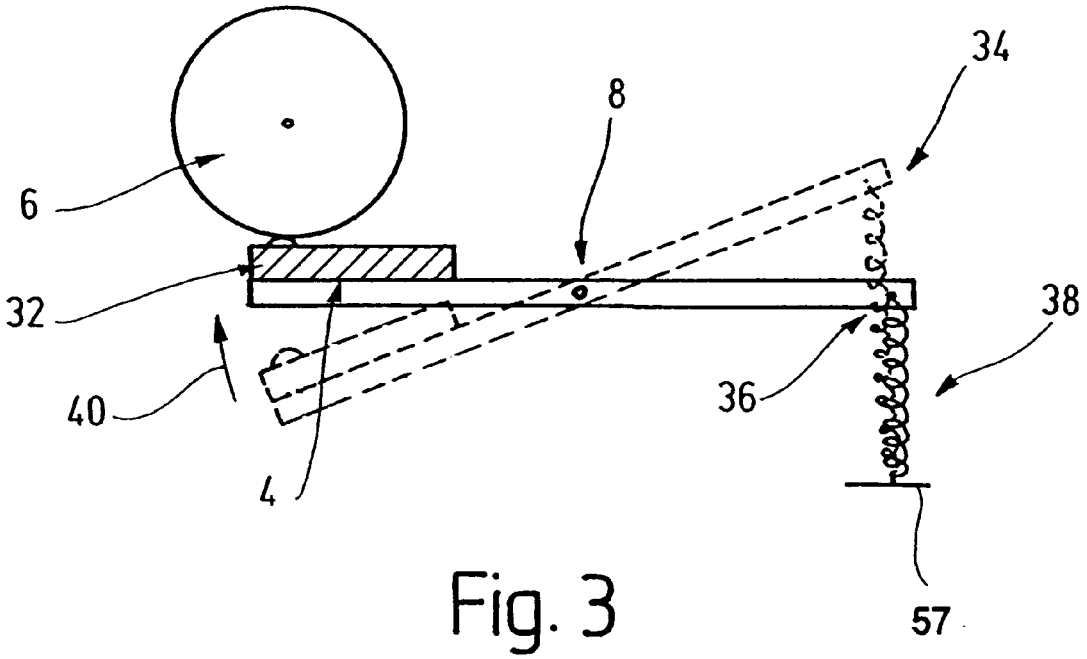
FIG. 3 is a view of a mounting mechanism for a print head.

FIG. 3 is a view of a print head support means 4 (as seen looking at the bottom of FIG. 1) which is pivotal between two positions 34, 36 about the pivot point 8 in a manner known in the art. In the first position 34 shown in broken lines, the pivotal print head support means 4 is positioned such that the print head 32 is spaced from the platen roll 6. In the second position 36 illustrated by solid lines, which is the printing position, the print head support means 4 is pivoted in a clockwise direction indicated by the arrow 40, such that the print head 32 makes contact with the platen roll 6. The contact pressure of the print head 32 is generated by means of a spring 38 located at the end of the twoarmed print head support means 4 opposite the print head 32. The pivotal movement is effected, as a rule, by a hinged lid closing the cassette receiving bay 2 relative to the outside and interacting with the thermal print head support means 4 in such a fashion that, with the lid open, the print head support means 4 occupies position 34. On the other hand, it is pivoted into position 36 with the lid closed. This is performed by means of the member 57, which is coupled to the lid as shown in FIGS. 7 to 12. A corresponding mechanism is disclosed in U.S. Pat. No. 5,424,757 to Thom whose contents are incorporated herein by reference. It is noted that the arm of the print head support means 4 shown to the right of the pivot point 8 is arranged beneath the cassette receiving bay 2 of the tape printing apparatus and is therefore not visible in FIG. 1, being concealed by the bottom of the cassette receiving bay 2.

Figure 4:
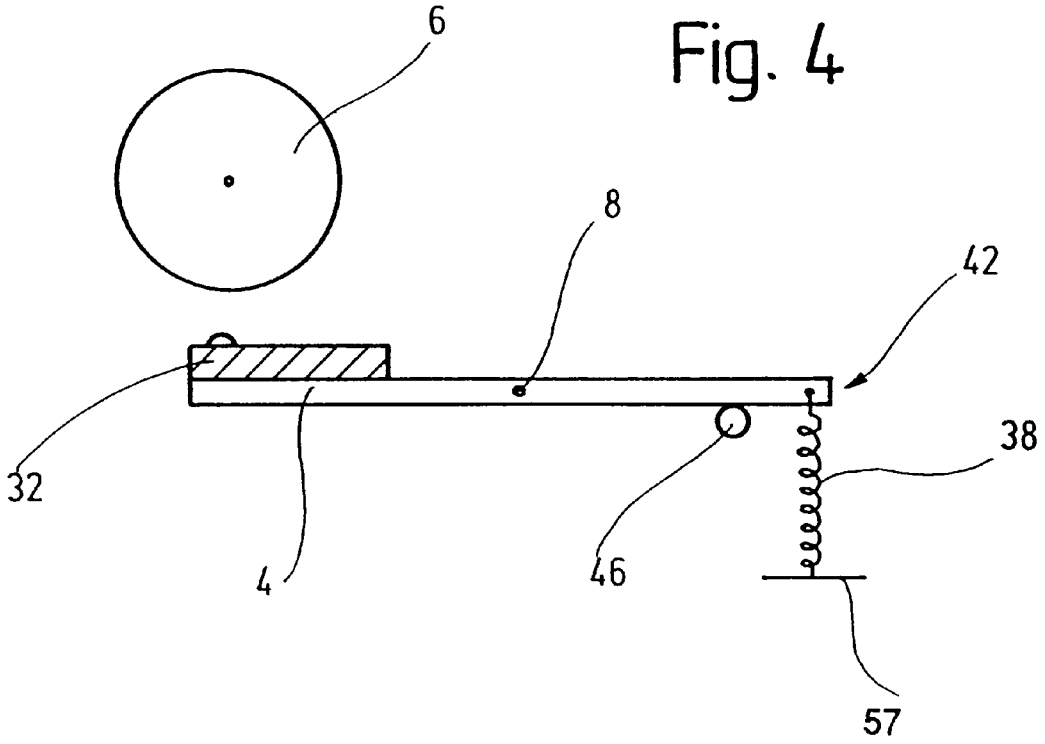
FIG. 4 is a view of a print head mounting mechanism in the locked position.

FIG. 4 shows the same view as in FIG. 3. It includes, however, the added provision of a stop means 46 against which the print head support means 4 abuts in the area of its right-hand arm opposite the print head 32. The stop means 46 serves the function of preventing the spring 38 from moving the print head support means 4 into position 36. The print head support means is thus in a position 42, in which the print head 32 is held clear of the platen roll 6, preventing deformation of the latter. Position 42 may be arranged to coincide with position 34 at least approximately, but it may also correspond to a pivot angle of the print head support means 4 which corresponds to a position intermediate of the positions 34 and 36, provided that the print head 32 does not make contact with the platen roll 6.

Figure 5:
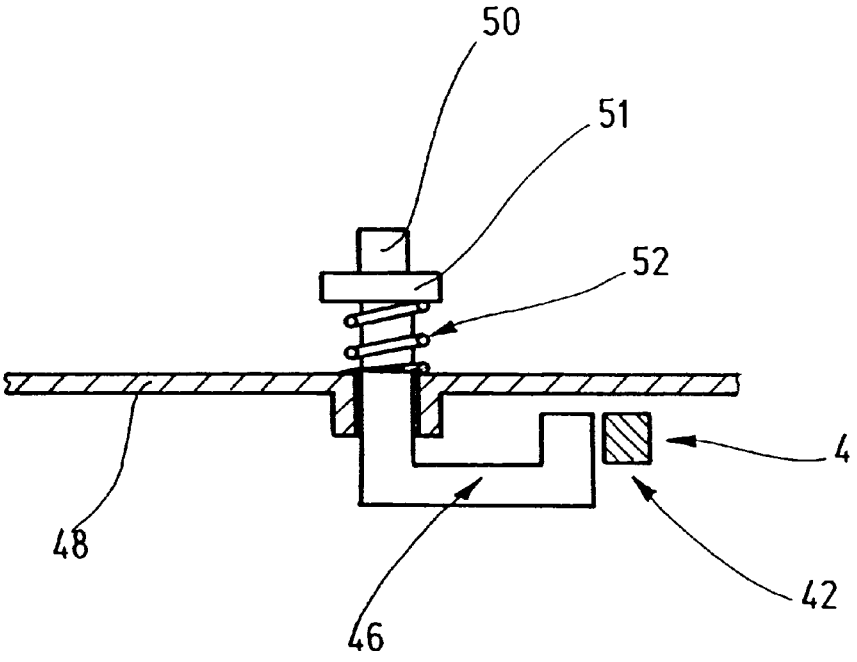
FIG. 5 is a view of a locking mechanism absent a cassette according to a first embodiment of the invention.

As becomes apparent from the side view of a first embodiment of the invention illustrated in FIG. 5, the stop means 46 for the print head support means is of an essentially U-shaped configuration. A shorter arm drawn to the right serves to restrict the pivotal movement of the print head support means 4, while the second, equally vertically aligned arm of the stop means 46 extends through a bottom plate 48, providing the bottom of the cassette receiving bay 2. Provided on the upper side of the second arm of the stop means 46 in the interior of the cassette receiving bay 2 is a cylindrical head 50 having a circumferential annular collar 51 which is spaced from the head end. The collar 51 serves as an abutment stop for a helical spring 52 extending circumferentially about the second arm and having its other end resting against the bottom plate 48. The stop means 46 for the print head support means is vertically slidably mounted in the bottom plate 48 through which it extends. In FIG. 5, the stop means 46 is in abutment with the print head support means 4, causing the print head support means to occupy the position 42 of FIG. 4.

Figure 6:
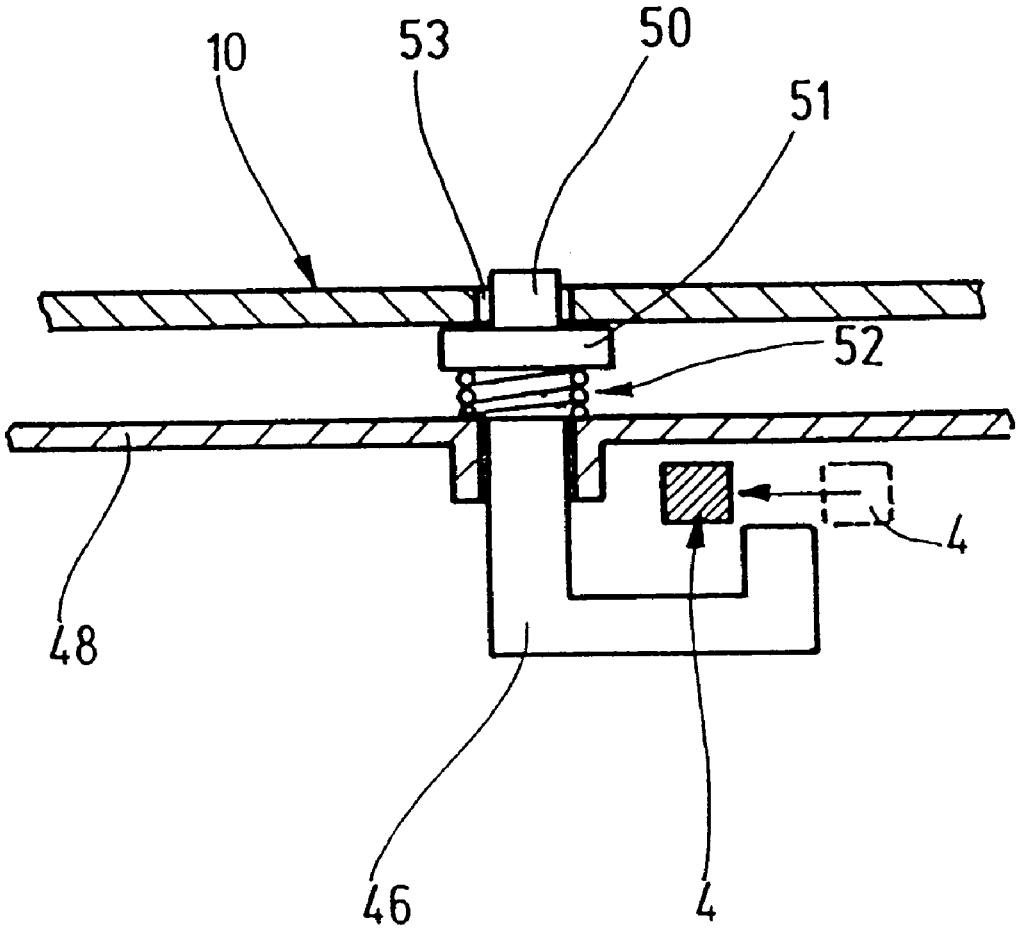
FIG. 6 is a view of the locking mechanism according to a first embodiment of the invention with a cassette inserted.

FIG. 6 shows a cassette 10 in an inserted condition in the cassette receiving bay 2. The cassette is provided an opening 53 into which the head 50 of the second arm of the stop means 46 for the print head support means extends. Effecting a lateral guiding function for the head 50, the opening 53 prevents wrong cassettes 10 from being loaded. Being in abutment with the cassette 10, the annular collar 51 is urged downwardly in the direction of the bottom plate 48. As a result, the stop means 46 for the print head support means is vertically downwardly displaced (relative to FIG. 5), causing the helical spring 52 to be compressed and the first, shorter arm of the stop means 46 to permit a movement of the print head support means 4 between the first position 34 and the second position 36. Because a cassette 10 is inserted, no risk is involved in urging the print head 32 into pressure contact with the platen roll 6. The pivotal movement of the print head support means 4—as effected, for example, by means of a lid of the cassette receiving bay 2 or an appropriate lever—may then proceed as illustrated in FIG. 3. Upon removal of the cassette 10, the helical spring 52 operates to return the stop means 46 to the position 42 illustrated in FIG. 5, thus preventing contact from being made between the platen roll 6 and the print head 32.

A second embodiment of the invention is shown in FIGS. 7 to 10. For ease of reference, the respective parts are denoted with the same reference numbers as in the previous figures.

Figure 7:
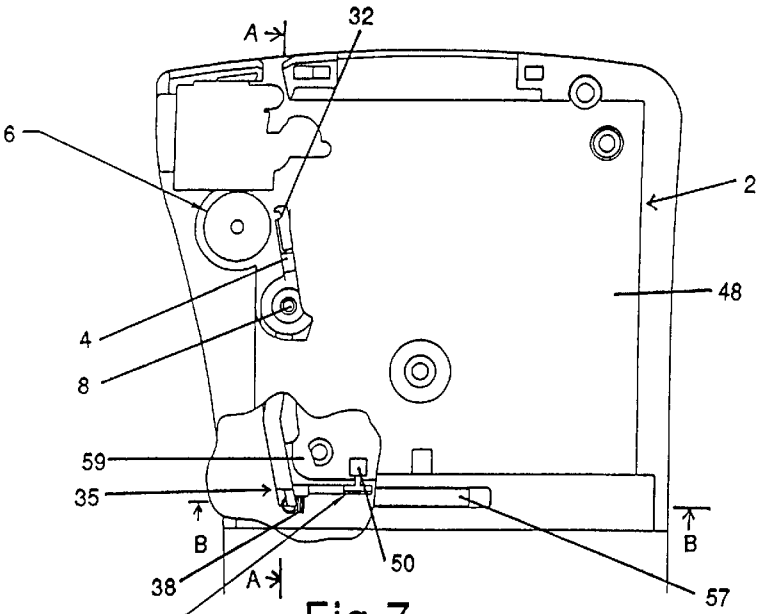
FIG. 7 is a view of a tape printing apparatus according to a second embodiment of the invention.

In FIG. 7, no cassette has been inserted into the cassette receiving bay 2. The print head 32 is mounted to a first arm of the print head support means 4, the latter being rotatably supported around vertically extending pivot point 8. A second arm of the print head support means 4 opposite to the first arm (carrying print head 32) is shown at the bottom of FIG. 7. This arm is connected to the first (left) end of a spring 38. The second end of the spring 38 is mounted to a rotatably supported member 57 having a pivot point extending vertically in the plane of FIG. 7. A rotation of member 57 causes a movement of the second end of the spring 38 such that it influences the position of the print head support means 4. Member 57 gets in touch with the lid 55 of the cassette receiving bay 2, as discussed later with respect to FIG. 9. The bottom plate 48 of the cassette receiving bay 2 is in FIG. 7 shown broken (opened) in order to display the spring 38 and the second arm of the print head support means 4; in reality it is closed. Below the bottom plate 48, a base plate 59 can be seen which is usually made of metal and supports, among others, the pivoting point 8 and the platen roll 6. The base plate 59 is oriented parallel to the bottom plate 48. An important part is the stop means 46 for the print head support means 4, which is located adjacent to the end of the second arm of the print head support means 4 and, due to the lack of a cassette in the cassette receiving bay 2, in a position in which it touches the second arm of the print head support means 4 such that the print head 32 rests in an inoperative position 35 which corresponds to the situation shown in FIG. 4.

Figure 8:
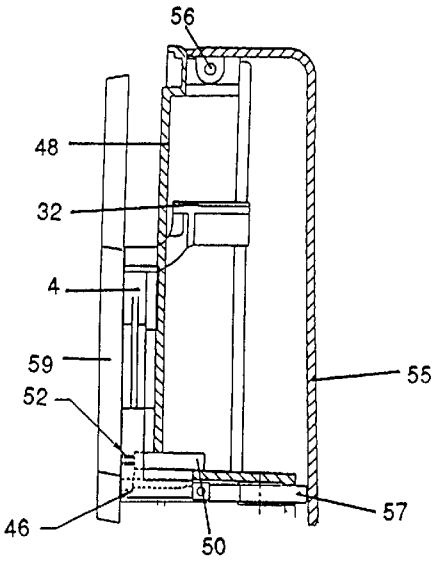
FIG. 8 is a view of the apparatus shown in FIG. 7 seen along lines A—A.

The stop means 46 for the print head support means 4 can be seen in FIG. 8 showing a cut through the apparatus of FIG. 7 along lines A—A. The stop means 46 extends through the bottom plate 48 into the cassette receiving bay 2, and is supported such that it can move horizontally in the plane of FIG. 8. It is loaded by a spring 52 such that it is forced into the rest position shown in FIG. 8. Insertion of a cassette 10 makes the stop means 46 move leftward against the action of the spring 52, as displayed in FIG. 11. FIG. 8 further shows the lid 55 covering the cassette receiving bay 2. The lid 55 is pivotal around pivot point 56 and is on its lower end contacting the rotatably supported member 57 connected to the second end of the spring 38.

Figure 9:
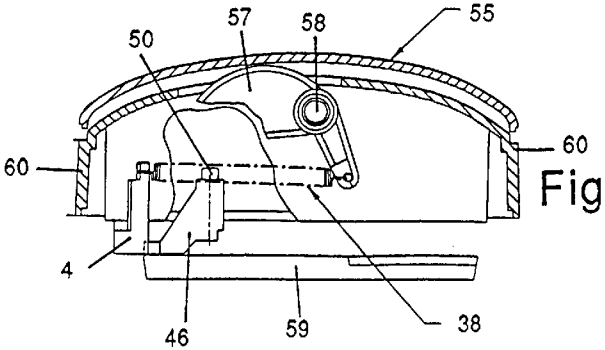
FIG. 9 is a view of the apparatus shown in FIG. 7 seen along lines B—B.

The rotatably supported member 57 is rotatable around pivot point 58 shown in FIG. 9, which is a cut through the apparatus of FIG. 9 along lines B—B. Movement of the lid 55 causes it to touch member 57 and makes the latter rotate such that the spring 38 is tightened when the lid 55 is closed and not tightened otherwise. FIG. 9 shows that the second arm of the print head support means touches the stop means 46 such that the print head 32 cannot reach its operative position although the lid is closed. The side walls of the cassette receiving bay 2 are denoted with the reference number 60.

Figure 10:
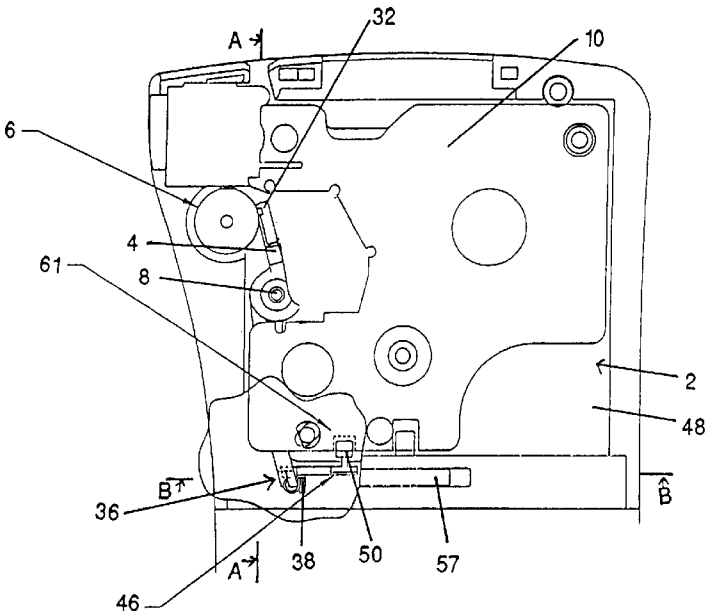
FIG. 10 is a view of the apparatus according to the second embodiment of the invention with a cassette inserted.

In FIG. 10, showing the same apparatus as FIG. 7, but with inserted cassette 10, the stop means 46 for the print head support means 4 have been depressed by the inserted cassette 10. As the lid 55 is closed, the print head 32 and the platen roll 6 are in their operative position 36 ready for printing. The cassette 10 has a recess 61 at its bottom side in which the head 50 of the stop means 46 is accommodated.

Figure 11:
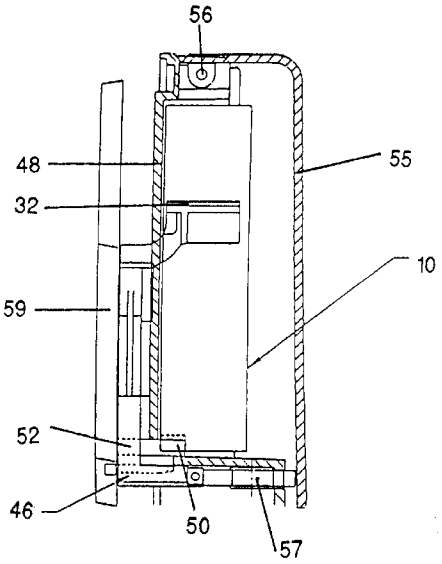
FIG. 11 is a view of the apparatus shown in FIG. 10 seen along lines A—A.
Figure 12:
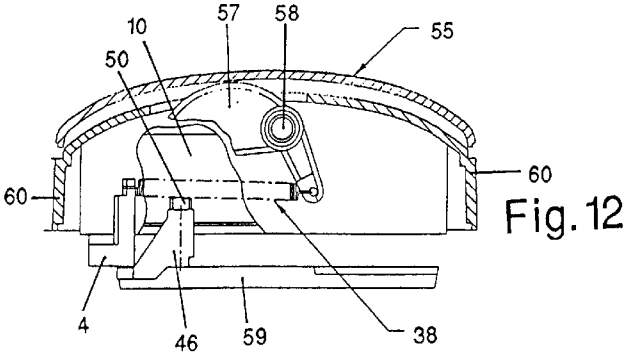
FIG. 12 is a view of the apparatus shown in FIG. 10 seen along lines B—B.

Due to the inserted cassette 10, the stop means 50 is depressed against action of spring 52, such that it is moved leftwards in FIG. 11. This movement corresponds to a downwards movement in FIG. 12. As can be seen in FIG. 12, the movement of the print head support means 4 is not blocked anymore by the lower left shoulder of the stop means 46, such that a closing movement of the lid 55 brings the print head 32 into its operative position 36.

What is claimed is:

1. A tape printing apparatus which comprises:

a cassette receiving bay adapted to receive a cassette which contains an image receiving tape, in which an openable lid on the cassette receiving bay is provided, and in which a print head and a platen roll are relatively movable into an operative position ready for printing, wherein one of the print head and the platen roll is operatively connected to said lid such that the print head and the platen roll are in an inoperative position when the lid is open, and means for detecting the presence of the cassette in the cassette receiving bay, said means preventing the print head and the platen roll from being moved into an operative position when said lid is closed in the absence of the cassette in the cassette receiving bay.

2. The tape printing apparatus according to claim 1, wherein one of the print head and the platen roll are mounted on a support means which is movable between a position in which the print head and the platen roll are in an operative position, and a position in which the print head and the platen roll are in an inoperative position, and means for detecting the presence of the cassette in the cassette receiving bay is movable into a position restricting the movement of the support means.

3. The tape printing apparatus according to claim 2, wherein, when the cassette is not loaded in the cassette receiving bay, the means for detecting the presence of the cassette in the cassette receiving bay permits only a movement of the support means between a position in which the print head and the platen roll are in an inoperative position, and a position in which the print head and the platen roll do not make contact.

4. The tape printing apparatus according to claim 2, wherein the support means is arranged to be pivotal about a pivot point.

5. The tape printing apparatus according to claim 1, wherein the means for detecting the presence of the cassette in the cassette receiving bay comprises a movable element whose movement is caused by the cassette being inserted into the cassette receiving bay.

6. The tape printing apparatus according to claim 5, wherein the element is slidably mounted.

7. The tape printing apparatus according to claim 5, wherein a first spring moves the element into a position restricting the movement of the support means when the cassette is not loaded in the cassette receiving bay.

8. The tape printing apparatus according to claim 5, wherein the element comprises a head positioned within a recess of the cassette inserted in the cassette receiving bay.

9. The tape printing apparatus according to claim 5, wherein the element extends through a bottom plate of said cassette receiving bay.

10. The tape printing apparatus according to claim 1, wherein one of the print head and the platen roll is connected to the lid by means of a second spring.

11. The tape printing apparatus according to claim 10, wherein one end of the second spring is coupled to a rotatably supported member, which engages with said lid when it is in its closed position.

12. The tape printing apparatus according to claim 2, wherein a third spring is coupled at one end to a rotatably supported member, which engages with the lid when it is in its closed position, and the third spring is coupled to the support means at the end opposite to the rotatably supported member.

13. The tape printing apparatus according to claim 2, wherein one of the print head and the platen roll is connected to the lid by means of a third spring.

14. The tape printing apparatus according to claim 13, wherein one end of the third spring is coupled to a rotatably supported member, which engages with the lid when it is in its closed position.

15. The tape printing apparatus according to claim 14, wherein the end of the third spring opposite to the rotatably supported member is coupled with the support means.

16. The tape printing apparatus according to claim 1, wherein the cassette, which is inserted or suitable for insertion into the cassette receiving bay, cooperates with the means for detecting the presence of a cassette such as to allow movement of the print head and platen roll into their operative positions when the cassette is inserted into the cassette receiving bay.

17. In combination, a tape printing apparatus according claim 1, and a cassette suitable for insertion into the cassette receiving bay, said cassette having means for cooperating with the means for detecting the presence of a cassette such as to allow a movement of the print head and the platen roll into their operative positions when the cassette is inserted into the cassette receiving bay of the tape printing apparatus.

18. A tape printing apparatus which comprises a cassette receiving bay on which an openable lid is provided, said cassette receiving bay being adapted to receive a cassette which contains an image receiving tape, and in said cassette receiving bay are disposed a print head and a platen roll which are relatively movable into an operative position ready for printing, wherein one of the print head and the platen roll is operatively connected to the lid such that the print head and the platen roll are in an inoperative position when the lid is open, and means for detecting the presence of the cassette in the cassette receiving bay, the means preventing the print head and the platen roll from being moved into an operative position when the lid is closed in the absence of the cassette in the cassette receiving bay.

19. A tape printing apparatus which comprises:

a cassette receiving bay in which an openable lid is provided, said cassette receiving bay adapted to receive a cassette which contains an image receiving tape, a print head, a platen roll, wherein the print head and the platen roll are disposed in said cassette receiving bay and are relatively movable into an operative position ready for printing, further wherein one of the print head and the platen roll is operatively connected to the lid such that the print head and the platen roll are in an inoperative position when the lid is open, and means for detecting the presence of the cassette in the cassette receiving bay, the means preventing the print head and the platen roll from being moved into an operative position when the lid is closed in the absence of the cassette in the cassette receiving bay.

* * * * *